US005223163A

United States Patent [19]

Coolbaugh

[11] Patent Number: 5,223,163

[45] Date of Patent: Jun. 29, 1993

[54] METAL PHENATES

[75] Inventor: Thomas S. Coolbaugh, Morrisville, Pa.

[73] Assignee: Mobil Oil Corporation, Fairfax, Va.

[21] Appl. No.: 854,047

[22] Filed: Mar. 18, 1992

[51] Int. Cl.[5] ..... C10M 135/10

[52] U.S. Cl. ..... 252/33.3; 252/18; 252/25; 252/33; 252/42.7; 252/48.6

[58] Field of Search ..... 252/18, 25, 33.2, 33

[56] References Cited

U.S. PATENT DOCUMENTS

| | | | |
|---|---|---|---|
| 2,680,096 | 6/1954 | Walker et al. | 252/42.7 |
| 2,680,097 | 6/1954 | Stewart | 252/42.7 |
| 3,178,368 | 4/1965 | Hanneman | 252/18 |
| 3,706,632 | 12/1972 | Day et al. | 252/18 |
| 3,810,837 | 5/1974 | Chafetz et al. | 252/18 |
| 4,049,560 | 9/1977 | Dominey | 252/18 |
| 4,710,308 | 12/1987 | Stauffer | 252/18 |
| 4,749,499 | 6/1988 | Damin et al. | 252/18 |
| 4,973,411 | 11/1990 | Jao et al. | 252/18 |

FOREIGN PATENT DOCUMENTS

| | | |
|---|---|---|
| 85102059 | 9/1986 | China . |
| 354647 | 2/1990 | European Pat. Off. . |
| 385616 | 9/1990 | European Pat. Off. . |

*Primary Examiner*—Ellen McAvoy

*Attorney, Agent, or Firm*—Alexander J. McKillop; Malcolm D. Keen; Jessica M. Sinnott

[57] ABSTRACT

Overbased metal phenates, preferably metal phenate sulfides, having a higher alkalinity, reflected by the total base number (TBN), and having good viscosity characteristics, are overbased in the presence of a carboxylic acid, preferably oleic acid and a dispersant composition. The dispersant composition comprises a dialkyl metal sulfosuccinate or a combination of the dialkyl metal sulfosuccinate and a metal hydrocarbylsulfonate. The preferred dialkyl metal sulfosuccinate is dioctyl-sodium sulfosuccinate. The preferred metal hydrocarbylsulfonate is calcium dinonylnaphthalenesulfonate, which imparts age and heat stability to the product. The overbased metal phenate sulfides are suitable as lubricant and functional fluid antioxidant additives.

26 Claims, 1 Drawing Sheet

METAL PHENATES

RELATED APPLICATION DATA

Reference is made to U.S. patent application Ser. No. 07/753,133, filed on Aug. 30, 1991, now U.S. Pat. No. 5,169,595 which is incorporated herein by reference in its entirety.

FIELD OF THE INVENTION

The invention is directed to metal phenates with improved viscometric properties and higher alkalinity. More specifically, the invention is directed to an improved method of making metal phenates by including a dispersant comprising an alkylcarboxylate compounds a metallic dispersant, namely a dialkyl-metal sulfosuccinate, and, optionally, a metal hydrocarbyl-sulfonate. This is an improved procedure for making overbased metal phenates having improved properties.

BACKGROUND OF THE INVENTION

The oxidation of a lubricating oil often leads to the formation of oil-insoluble products which form particles that separate from the oil in a form of sludge, lacquer or varnish-like coating on engine parts.

Neutral and overbased alkaline-earth metal phenate sulfides have been known for their excellent dispersing properties and the ability to neutralize engine acids. Use has been found for these compositions primarily as additives in lubricating oils.

Overbased metal phenate sulfides contain high levels of alkali or alkaline earth metals. The measure of their alkalinity is determined by titration with acid (such as perchloric acid) and represented by the total base number (TBN). The TBN is the milligram equivalent of potassium hydroxide per gram of sample. They possess strong detergent power and an even greater capacity to neutralize acidic contaminants than the neutral metal phenate sulfides. However, overbased metal phenate sulfides which contain high levels of metal have been found to be undesirably viscous in many cases. One theory is that the high viscosity may be related to a higher solids content of overbased products which possibly contain calcium carbonate in particulate form as well as the likely presence of multivalent metal salts which may crosslink with other molecules resulting in a more viscous product. Support for this theory is in a finding that above a certain level of alkalinity undissolved solids become an increasing problem. It would be desirable to increase the alkalinity level of these additives without the high viscosity problems.

The conventional method of making overbased phenate sulfide detergents involves mixing long chain alkyl substituted phenols, a source of sulfur and an excess of metallic base. Carbonation of the reaction mass follows to increase the amount of metal base homogeneously dispersed in the final product.

In U.S. patent application Ser. No. 753,133 there is described metal phenate sulfides and a method of making metal phenate sulfides by incorporating a dispersant, preferably a metallic dispersant in the reaction mixture. The phenate sulfide reaction product exhibits improved viscometric properties and higher alkalinity.

European patent application No. 90301684.1 describes a method of making overbased phenate sulfides by including a carboxylic acid in the reaction mixture. The carboxylic acid is described as increasing the total base number (TBN) of the phenate sulfide product.

Disadvantages encountered in making phenates in a manner based on the process described include the production of substantial amounts of undissolved solids prior to filtration causing slow filtration and foaming during vacuum stripping. These are serious impediments to commercial manufacture. Moreover, the products display a tendency to form a precipitate upon aging.

A faster, more efficient process for making overbased phenates would be economically advantageous Thus, a product with reduced solids levels which filters rapidly and does not produce foam while possessing a higher alkalinity at a suitable viscosity would improve processing efficiency and performance results.

SUMMARY OF THE INVENTION

This invention is directed to improved overbased metal derivatives of phenates which have a high alkalinity, and improved viscosity properties. The invention is also directed to an improved method of making the phenates which is commercially practical. Specifically, the invention is directed to highly alkaline low viscosity overbased phenates comprising the overbased reaction product of a source of alkylated phenol, and a source of an alkali or alkaline earth metal containing reagent which is overbased in the presence of a dispersant composition and a carboxylic acid or its derivative. The invention is also directed to a process for preparing overbased metal phenates which comprises the reaction product of a source of alkylated phenol, a source of an alkali or alkaline earth metal and a dispersant which is overbased in the presence of a carboxylic acid or its derivative.

A feature of the invention is to overbase a metal phenate in the presence of a carboxylic acid or its derivative and a dispersant which includes a dialkyl-metal sulfosuccinate to produce highly alkaline overbased phenates which have good viscosity properties.

An additional feature of the invention is an overbased phenate which is further overbased in the presence of additional alkali or alkaline earth metal reagent and in the presence of a carboxylic acid or its derivative and a dispersant. Therefore, the starting overbased phenate can be obtained commercially or it can be synthesized in any manner known in the art. Alternatively, the phenate can be prepared in accordance with a special procedure described in U.S. patent application Ser. No. 753,133.

An advantage of the invention is that highly alkaline phenates which have improved viscosity characteristics can now be more easily manufactured by including a carboxylic acid or its derivative and a dispersant composition which includes a dialkyl-metal sulfosuccinate in the synthesis of overbased metal phenates.

The phenates of the invention can be utilized in various lubrication oils for internal combustion engines; namely heavy duty diesel engines since the phenates possess an exceedingly high total base number (TBN) without the disadvantages of an exceedingly high viscosity product.

DETAILED DESCRIPTION OF THE INVENTION

Figure 1:
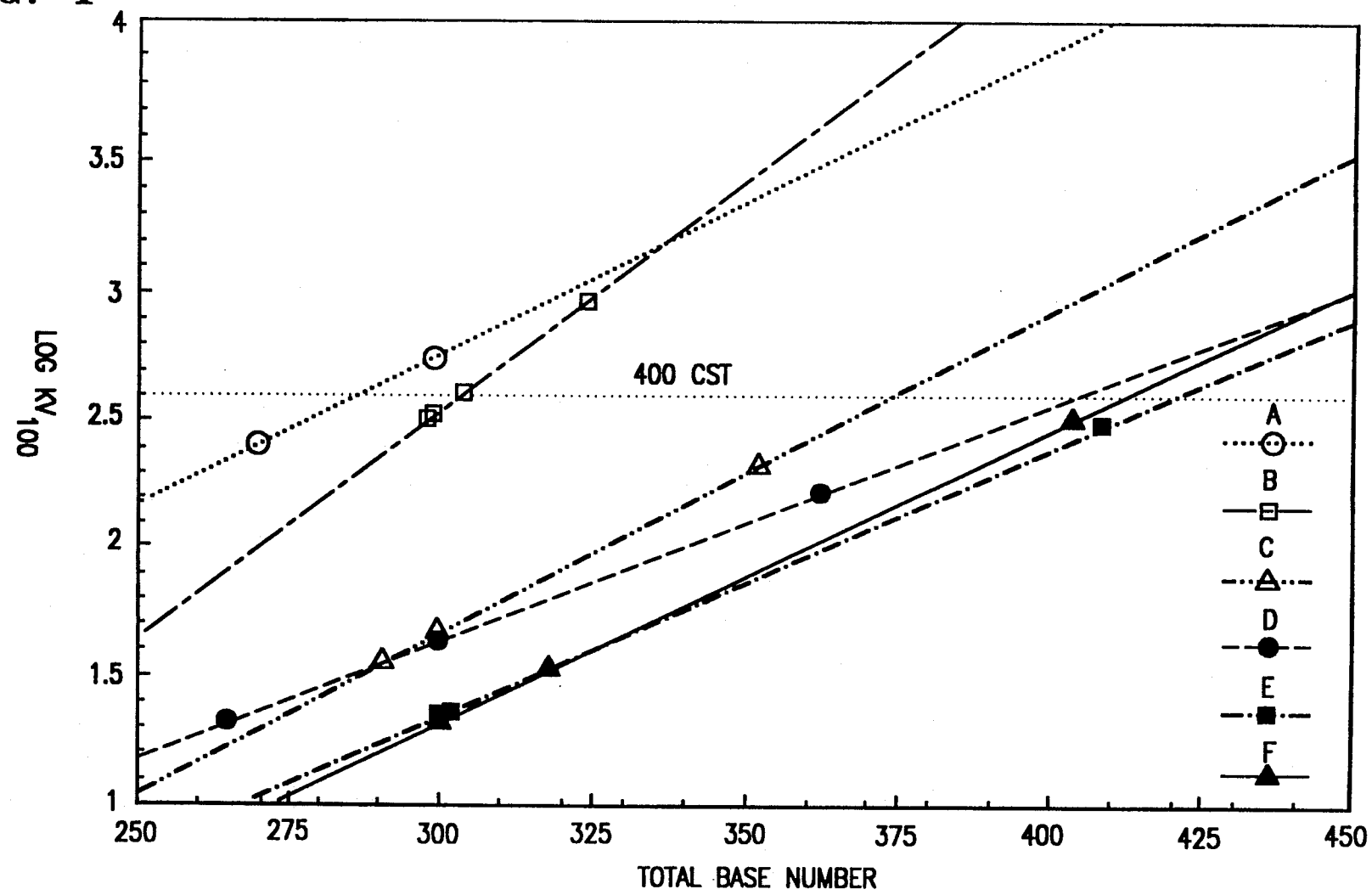
FIG. 1 is a graph of the total base number (TBN) and kinematic viscosity (Log $kV_{100}$) which illustrates the effect of the alkylcarboxylate and the dispersants (dioctyl-sodium sulfosuccinate and dinonylnaphthalenesulfonate) on the properties of metal phenate sulfides made in accordance with the invention.

Basically, the procedure for making the phenates commences with a source of alkylated phenol, alkali or alkaline earth metal-containing material, and optionally, a source of sulfur.

The source of alkylated phenol from which the starting overbased phenates are derived has the formula:

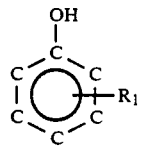

where $R_1$ is an alkyl group. Preferably $R_1$ is a long chain alkyl group which contains at least 6 carbon atoms, ranging from 6 to 50 carbon atoms, preferably 9 to 20 carbon atoms. The phenol may be alkylated by any known technique. Known alkylation methods include reaction between olefins or alkyl halides and phenols. The reaction can be conducted in the presence of a catalyst to promote the reaction such as a Lewis acid, e.g. aluminum chloride, boron trifluoride, hydrogen fluoride and the like. The long chain alkyl group may be derived from propylenes, butenes, pentenes, hexenes, decenes, dodecenes, octadecenes, eicosenes and olefins of a maximum of 50 carbon atoms. It is anticipated that suitable alkyl phenols may also contain cyclic hydrocarbyl groups such as phenyl and cyclohexyl.

The alkylphenol is further reacted with at least one of a source of an alkali or alkaline earth metal-containing reagent to form the metal alkyl phenate. Suitable alkali or alkaline earth metal-containing materials include alkali or alkaline earth metal reagents which can contain any member of the alkali or alkaline earth metals such as sodium, potassium, lithium, calcium, magnesium, strontium and the like. The alkali or alkaline earth metal material can be an oxide, hydroxide, alcoholate or amine. Representative examples include calcium oxide and calcium hydroxide. Calcium hydroxide is preferred.

The amount of alkali or alkaline earth metal-containing material which is to be used in the reaction mixture depends on the preferred degree of alkalinity of the final product. The preferred alkalinity determines the stoichiometry of the starting materials. It is most advantageous to incorporate the highest mole % of metal to phenate as possible. Although the amount of metal is limited by strict viscosity and flow specifications, in accordance with the instant invention, a higher mole ratio of metal can be used in the reaction mixture without unduly increasing the product viscosity. Thus, the amount of alkali or alkaline earth metal which can be used in the instant invention is more than an equivalent amount, at least 150%, ranging from 150 to 350%, preferably from 180 to 250% by mole of the alkyl phenol.

In a preferred embodiment, the alkyl phenol is treated with a sulfur compound to prepare alkyl phenate sulfides. The alkyl phenol sulfide intermediates are prepared by reacting the alkylated phenol with at least one of a source of sulfur such as, elemental sulfur or a sulfur compound such as sulfur dichloride. The amount of sulfur used in the synthesis mixture is at least 100 mole % based on the alkyl phenol. Preferably, the amount of sulfur ranges from 150 to 200 mole %.

In one embodiment of the invention a dispersant composition is incorporated in the reaction mixture for making the phenate. The procedure is described in Ser. No. 753,133. The dispersant includes a sulfosuccinate which aids in the dispersion of the solids present in the overbased starting material, thereby facilitating the manufacture of a highly alkaline starting material.

The sulfosuccinate dispersant is, preferably, a dialkylmetal sulfosuccinate which has the general formula;

$$\left[ R_2CO_2-CH_2-\underset{\underset{SO_3^-}{|}}{CH}-CO_2R_3 \right]_n X$$

The alkyl group of the sulfosuccinate represented by $R_2$ and $R_3$ can contain at least 4 carbon atoms, ranging from 4 to 16 carbon atoms, preferably 4 to 13 carbon atoms. X represents an alkali or alkaline earth metal and n is the valence of X. $R_2$ and $R_3$ are aliphatic groups which may be straight chain or branched and can be the same or different. Representative examples of alkyl groups include butyl, pentyl, hexyl, octyl, decyl and dodecyl as well as branched alkyl groups such as ethylhexyl. The sulfosuccinate reacts and decomposes during the synthesis. A by-product of the decomposition reaction is an alcohol which is removed from the final product. To facilitate removal of the alcohol the alkyl group is preferably of a low carbon number, i.e. at least $C_4$, ranging from $C_4$ to $C_{13}$ and not exceeding $C_{16}$.

The metal component of the alkyl metal-sulfosuccinate which is represented by X can be any metal selected from the alkali metals and alkaline earth metals groups, Group IA and Group IIA of the Periodic Table of the Elements, including lithium, sodium, potassium, calcium, magnesium, beryllium, strontium and barium.

The alkyl metal sulfosuccinates are derived by esterification of maleic anhydride with an alcohol followed by addition of a metal bisulfite. The succinates can also be obtained commercially. The preferred succinate is dioctyl-sodium sulfosuccinate, which is also known as di(2-ethylhexyl) sodium sulfosuccinate. Dioctyl-sodium sulfosuccinate has the following structural formula:

$$C_8H_{17}OOCCH_2CH(SO_3Na)COOC_8H_{17}$$

The incorporation of the dialkyl metal sulfosuccinate provides a higher alkalinity content product without increasing the product viscosity.

The amount of dialkyl-metal sulfosuccinate in the reaction mixture depends on the desired viscosity and preferred degree of alkalinity. In the very highly alkaline product, i.e., that which is greater than 280 total base number, the amount of the dialkyl-metal sulfosuccinate should be at least 1% ranging from 2 to 20%. The preferred amount of dialkyl-metal sulfosuccinate is 2 to 16% based on the total amount of alkylphenol.

The dispersant composition can also include a second dispersant, preferably another metallic dispersant, along with the dialkyl-metal sulfosuccinate. This dispersant should have properties which facilitate suspension of the metal in solution, promote compatibility of the dispersed metal in the final product and help the product resist aging. A suitable dispersant is a metal hydrocarbylsulfonate.

The metal hydrocarbylsulfonate can be generally represented by the formula $R_4-SO_{3m}Y$ where Y is a group IA metal or a group IIA metal, m is the valence of Y and $R_4$ is the hydrocarbyl group which can contain 8 to 50 carbon atoms.

The hydrocarbyl group of the metal hydrocarbylsulfonate, represented by $R_4$, contains at least 8 carbon atoms, ranging from 8 to 50 carbon atoms, preferably from 12 to 36 carbon atoms. The hydrocarbyl is preferably aromatic with at least one alkyl substituent bonded to the aromatic. Suitable alkyl substituents contain 4 to 16 carbon atoms, a representative example of which is nonyl. Aromatic hydrocarbyls contemplated are phenyl and fused ring aromatics such as naphthalene. The metal, represented by Y, is a group IA or IIA metal of the Periodic Table of the Elements such as beryllium, magnesium, calcium, strontium, barium and radium as well as lithium, sodium and potassium. The preferred sulfonate is calcium dinonylnaphthalene sulfonate which is made by sulfonating dinonylnaphthalene with acetyl sulfate, for example.

The amount of metal hydrocarbylsulfonate used can depend on the desired degree of age resistance as indicated by solution clarity and is relative to the amount of dialkyl-metal sulfosuccinate used in the preparation of the phenates. In the preferred embodiment, the ratio of dialkyl-metal sulfosuccinate to metal hydrocarbylsulfonate is expressed in molar terms of at least 1:1, ranging from 2:10 and preferably from 2:5 moles of dialkyl-metal sulfosuccinate per mole of metal hydrocarbylsulfonate.

In overbasing the reaction products, the metal phenate is treated in the presence of excess metal compound with a reactive species, such as $CO_2$ which is capable of forming covalent bonds with the metal. In a preferred embodiment, carbon dioxide is introduced to the reactor while a temperature of at least 150° C, ranging from 150°-180° C. is maintained for a period of at least 60 minutes, preferably from 100 to 250 minutes. The amount of carbon dioxide added to the reaction mixture can range from 0.25 to 1.5 moles, preferably from 0.5 to 1.0 moles of carbon dioxide per mole of basic metal reagent.

In accordance with the invention, the overbased phenate starting material is subjected to overbasing in the presence of a carboxylic acid or its derivative as well as the dispersant. Thus, an essential feature of the invention is the carboxylic acid or its derivative.

The carboxylic acid, or its derivative, probably has effective dispersant activity which further facilitates solubility of the inorganic alkali or alkaline earth metal materials in the phenate while maintaining a low viscosity. The carboxylic acids contemplated are monocarboxylic acids; that is, there is only one carbonyl group (i.e. C=0). More than one carbonyl as in the dicarboxylic acids and dimer acids may add to cross linking reactions which would increase product viscosity, an undesirable result.

The carboxylic acid or derivative can be represented by the structural formula:

$$R_5—COZ$$

where $R_5$ is an alkyl group containing from about 10 to 25 carbon atoms, preferably from 12 to 20 carbon atoms. The alkyl group ($R_5$) can be saturated, monounsaturated or polyunsaturated. The alkyl group can also be straight chain or branched. Z is OH, OR', $NH_2$ or NHR' where R' is an alkyl group containing 1 to 20, preferably 1 to 12 carbon atoms, alcohol or alkyl polyol containing 2 to 20, preferably 2 to 6 carbon atoms.

Specific examples of suitable carboxylic acids are relatively long chain fatty acids containing from at least about 10 carbon atoms and greater, preferably from 12 to 20 carbon atoms. The long chain fatty acids are preferred, for solubility purposes.

Representative examples of suitable carboxylic acid compounds include the higher molecular weight carboxylic acids such as decanoic acid, undecanoic acid, dodecanoic acid, myristic acid, palmitic acid, hexadecanoic acid, octadecanoic acid (or stearic acid) and eicosanoic acid. Also contemplated are carboxylic acids of even higher molecular weight which contain over twenty carbon atoms such as docosanoic acid, tetracosanoic acid, hexacosanoic acid. Examples of monounsaturated acids contemplated include oleic acid, myristoleic acid, palmitoleic acid and ricinoleic acid. Examples of polyunsaturated acids include sorbic acid, linoleic acid, linolelaidic, and linolenic acid. Derivatives of carboxylic acids which are specifically contemplated include carboxylate esters. Specific carboxylate esters include methyl and butyloleate, glycerolmonooleate and glycerol trioleate. The carboxylic esters may exhibit superior performance characteristics since, prior to reaching an elevated temperature they are not expected to react with the alkali or alkaline earth metal material. Moreover, the polyhydric alcohol esters have the added advantage of being in situ sources of polyols, thereby at least partially reducing the need for the addition of materials such as ethylene glycol during the synthesis.

The invention concerns the production of overbased phenates in the presence of the carboxylic acid or its derivative and the dispersant. The dispersant need not be added during the overbasing step and can be present during overbasing by virtue of its having been included among the starting materials for making the metal phenate reaction product. However, the invention is also directed to the discovery that the presence of the dispersant and the carboxylic acid or its derivative during the synthesis is essential. Therefore, the invention contemplates, in one aspect, overbasing a phenate or phenate sulfide with the dispersant composition and carboxylic acid or its derivative in the presence of the basic metal reagent and carbon dioxide to increase the total base number (TBN) of the product.

In another embodiment, an as-synthesized high TBN phenate or phenate sulfide is made in accordance with the procedure described in Ser. No. 753,133. In this embodiment the overbased phenate is further overbased in the presence of a carboxylic acid or its derivative and the addition of DIOSS and/or DINNS during the overbasing step is not necessary since it was added prior to overbasing.

The amount of carboxylic acid employed ranges from 0.07 to 0.15, preferably 0.08 to 0.13 moles of carboxylic acid or derivative to 100 g of overbased calcium phenate or phenate sulfide to achieve a total base number over about 250.

A catalyst can be included in the reaction mixture to promote the overbasing. A suitable catalyst is an ammonium halide in which the halide is chloride, iodide, fluoride or bromide. A preferred catalyst is ammonium chloride.

Any suitable diluent or solvent can be used in which the metal phenate sulfide has some degree of solubility. Suitable solvents include mineral oils of about 4 cSt at 100° C., and aromatic hydrocarbons such as, toluene or xylenes. The solvent may also comprise a monohydric alcohol such as isodecyl alcohol or 2-ethylhexanol or a diol such as ethylene glycol. The alcohols are useful in the reaction mixture to increase the solubility of the reactants and promote reaction, thereby increasing the product yield. A combination of the foregoing solvents can also be used, such as a combination of mineral oil, ethylene glycol and isodecyl alcohol or 2-ethylhexanol.

The reaction temperature should be at least 100° C., ranging from 110° to 150° C., preferably from 115 to 135° C. While adding the dispersant and carboxylic acid. This temperature should be maintained until liquid evolution ceases, and then raised to at least 160° C. ranging from 165° to 150° C.

The pressure of reaction does not appear to be critical. However, the synthesis can be conducted over a pressure range varying from atmospheric (i.e. 760 mmHg) to 100 mmHg, preferably from atmospheric to 250 mmHg.

When the dispersant composition is utilized during the overbasing step it can be added to the reaction mixture at any time during the synthesis. This also applies when the dispersant is used in making the high TBN starting phenate. In either case, the dispersant can be added initially along with the starting materials, gradually during the initial overbasing step, gradually during the final overbasing step, or a combination of these steps can be used. For example, 10% can be added initially with addition of the remaining 90% during the carbonation step. In any event, preferably, the carboxylic acid is added during the final overbasing step.

For optimum performance of the additive in lubricating oils, the viscosity characteristics of the final metal phenate should not exceed about 1000 cSt at 100° C., ranging from 100 to 700 cSt, preferably from 200 to 500 cSt while the total base number can be as high as 450, ranging from 250 to 350, preferably from 290 to 350.

The metal phenates of the instant invention may be employed in lubricating oil compositions, both mineral oil and synthetic oils. They may also be beneficial in greases. Specific functional lubricants which will benefit from the additives include marine diesel lubricants which require a good dispersant with strong antioxidant properties, railroad engine lubricants, automobile lubricants and other functional fluids.

The invention disclosed herein suitably may be practiced in the absence of any component, element or step which is not specifically disclosed herein.

The following examples describe the invention in more complete detail.

EXAMPLE 1

This example demonstrates the preparation of an overbased calcium phenate.

To a 2L resin kettle equipped with variable speed stirrer, heater, thermocouple, condensor, Dean-Stark trap, a caustic scrubber and nitrogen, carbon dioxide and vacuum inlets was charged 400.0g of dodecylphenol, 282.0g of mineral oil, 180g of isodecyl alcohol, 253.6g of calcium hydroxide and 80.4g of elemental sulfur. The mixture was purged with nitrogen at a flow rate of about 50 mL per minute and the temperature was raised to 121° C. with stirring.

When the temperature reached 121° C., 104.0 mL of ethylene glycol were fed to the reaction mixture via syringe over a period of one hour. Following this, the temperature was raised to 177° C., the nitrogen flow rate was increased to approximately 100 mL per minute for a period of two hours. The temperature was then maintained at 177° C. while the pressure was reduced to about 500 mm of Hg. A two-phase distillate (63g) composed of water, ethylene glycol, ethylhexyl alcohol and isodecyl alcohol was collected over a thirty minute period.

The pressure was then increased to atmospheric by introduction of nitrogen. Carbon dioxide (114.8 g) was then fed over a two hour period at 177° C. During the carbon dioxide addition the reaction mixture changed from a hazy appearance to one of transparency. When addition was complete, the pressure was reduced to 40 mm Hg and the temperature was increased to about 200° C. Approximately 220 g of a two-phase distillate was collected over a two-hour period. The distillate was composed primarily of isodecyl alcohol and ethylene glycol.

The reaction mixture was allowed to cool to approximately 100° C., diluted with toluene, suction filtered through Celite 545 and solvent was then removed under reduced pressure to yield about 1 Kg of product as a viscous, dark amber fluid. Total base number=271 and $kv_{100}$=252 cST. The product was designated Sample A.

EXAMPLE 2

This example demonstrates the preparation of overbased phenate sulfides with the addition of a dispersant in the synthesis mixture.

A calcium phenate sulfide was made as described in Example 1, with the exception that 48g of dioctylsodium sulfosuccinate (DIOSS) was used. Total base number =306 and $KV_{100}$=406. The product was designated Sample B.

EXAMPLE 3

This example demonstrates the preparation of an overbased calcium phenate sulfide by the addition of the carboxylic acid.

The calcium phenate sulfide was prepared by a procedure similar to that described in EP 90301684.1.

To a 2000 mL resin kettle equipped with variable speed stirrer, heater, thermocouple, condensor, Dean-Stark trap, caustic scrubber and nitrogen, carbon dioxide and vacuum inlets was charged 500.0 g of overbased-calcium phenate-sulfide of approximately 250 TBN (Sample A), 56.4 g of mineral oil, 136.8 g oleic acid, 6.4 g ammonium chloride, and 143.6 g of calcium hydroxide. The mixture was purged with nitrogen at a flow rate of about 50 mL per minute and the temperature was raised to about 100° C. with stirring. Vacuum was applied in order to achieve a pressure of about 630 mm Hg.

After one hour, the temperature was raised to about 115° C., while maintaining the reactor pressure at 630 mm Hg, and 328.4 g of 2-ethylhexanol were added. The temperature was then raised to 145° C and 69.6 g of ethylene glycol were added quickly (<1 minute), still maintaining slight vacuum. Severe foaming was observed during these steps.

After stirring for five minutes, pressure was increased to atmospheric and carbon dioxide (143.6 g) was added over a period of about three hours at a temperature of about 140° C. to 150° C. During this time, the reaction mixture changed in appearance from extreme cloudiness to near transparency, indicating the incorporation of calcium carbonate. When the addition was complete, the pressure was reduced to 40 mm Hg and the temperature was increased to about 210° C. Approximately 319 g of a single-phase distillate was collected over a two hour period. The distillate was composed primarily of ethylhexanol.

The reaction mixture was allowed to cool to about 100° C., diluted with toluene, suction filtered through Celite. Suction filtration was slow and a tendency to clog the top surface of the filter medium, i.e. blinding was observed. Solvent was removed under reduced pressure to yield approximately 700 g of product as a viscous, dark fluid.

Total base number=353 and $KV_{100}$=191 cST. The product was designated Sample C.

EXAMPLE 4

This example demonstrates the preparation of an improved overbased calcium phenate sulfide by the addition of a dispersant (DIOSS and DINNS) and the carboxylic acid.

To a 500 mL resin kettle equipped with variable speed stirrer, heater, thermocouple, condensor, Dean-Stark trap, caustic scrubber and nitrogen, carbon dioxide and vacuum inlets was charged 100.0 g of overbased-calcium phenate-sulfide of approximately 250 TBN (Sample A), 7.9 g of mineral oil, 27.4 g oleic acid, 1.3 g ammonium chloride, 3.7 g sodium dioctylsulfosuccinate, 3.4 g calcium dinonylnaphthalenesulfonate (50% in mineral oil) and 28.7 g of calcium hydroxide. The mixture was purged with nitrogen at a flow rate of about 50 mL per minute and the temperature was raised to about 100° C. with stirring. Vacuum was applied in order to achieve a pressure of about 630 mm Hg.

After one hour, the temperature was raised to about 120° C., while maintaining the reactor pressure at 630 mm Hg, and 65.7 g of 2-ethylhexanol were added. The temperature was then raised to 135° C. and 13.9 g of ethylene glycol were added quickly (<1 minute), still maintaining slight vacuum.

After stirring for five minutes, pressure was increased to atmospheric and carbon dioxide (28.7 g) was added over a period of about two hours at a temperature of about 140° C. During this time, the reaction mixture changed in appearance from extreme cloudiness to transparency, indicating the incorporation of calcium carbonate. When the addition was complete, the pressure was reduced to 40 mm Hg and the temperature was increased to about 210° C. Approximately 83 g of a two-phase distillate was collected over a two hour period. The distillate was composed primarily of ethylene glycol/water (bottom phase) and ethylhexanol (top phase).

The reaction mixture was allowed to cool to about 100° C., diluted with toluene, suction filtered through Celite. Solvent was removed under reduced pressure to yield approximately 150 g of product as a viscous, dark fluid. Total base number=363 and $KV_{100}$=149 cST. The product was designated Sample D.

EXAMPLE 5

This example demonstrates the preparation of an as-synthesized high TBN overbased calcium phenate sulfide by the addition of a dispersant (DIOSS) and the carboxylic acid.

To a 1000 mL resin kettle equipped with variable speed stirrer, heater, thermocouple, condensor, Dean-Stark trap, caustic scrubber and nitrogen, carbon dioxide and vacuum inlets was charged 250.0 g of overbased-calcium phenate-sulfide of approximately 250 TBN (Sample B), 28.2 g of mineral oil, 68.4 g oleic acid, 3.2 g ammonium chloride, and 71.8 g of calcium hydroxide. The mixture was purged with nitrogen at a flow rate of about 50 mL per minute and the temperature was raised to about 100° C. with stirring. Vacuum was applied in order to achieve a pressure of about 630 mm Hg.

After one hour, the temperature was raised to about 120° C., while maintaining the reactor pressure at 630 mm Hg, and 65.7 g of 2-ethylhexanol were added. The temperature was then raised to 130° C. and 34.8 g of ethylene glycol were added quickly (<1 minute), still maintaining slight vacuum.

After stirring for five minutes, pressure was increased to atmospheric and carbon dioxide (71.8 g) was added over a period of about two hours at a temperature of about 140° C. During this time, the reaction mixture changed in appearance from extreme cloudiness to transparency, indicating the incorporation of calcium carbonate. When the addition was complete, the pressure was reduced to 130 mm Hg and the temperature was increased to about 210° C. Although a crack in the apparatus prevented accurate measurement, approximately 83 g of a two-phase distillate was collected over a two hour period. The distillate was composed primarily of ethylene glycol/water (bottom phase) and ethylhexanol (top phase).

The reaction mixture was allowed to cool to about 100° C, diluted with toluene, suction filtered through Celite. Solvent was removed under reduced pressure to yield approximately 350 g of product as a viscous, dark fluid. Total base number =417 and $KV_{100}$=311 cST. The product was designated Sample E.

EXAMPLE 6

This example demonstrates the preparation of an as-synthesized high TBN overbased calcium phenate sulfide by the addition of a dispersant (DIOSS and DINNS and the carboxylic acid).

The procedure of Example 6 was followed except that 85 g DINNS was added along with the oleic acid. The product was designated Sample F.

EVALUATION OF THE PRODUCTS

The alkalinity of the products of each of the examples was determined by titration with acid and was expressed as total base number (TBN) based on milligrams of KOH per gram of sample.

The products were subjected to aging in a standard reference oil for 96 hours at 70° C, and 4% loading in a standard reference oil.

Table 1 presents a summary of the composition and properties of the products of each of the examples.

TABLE 1

| | Starting Phenates | | Phenate/Carboxylates | | | |
|---|---|---|---|---|---|---|
| Sample | A | B | C | D | E | F |
| Starting Phenate | — | — | A | A | B | B |
| TBN | 271 | 306 | 353 | 363 | 417 | 410 |
| $KV_{100}$ | 252 | 406 | 191 | 149 | 311 | 318 |
| VI | 101 | 82 | 179 | 164 | 193 | 180 |
| Oven Storage | clear | hazy | sl. hazy | clear | v. sl. hazy | v. clear |
| Sediment | — | 1% | 5.94% | 3.92% | 2.07% | 2.46% |
| Initial | | | | | | |
| Final | trace | <.2 | 1.92 | 0.69 | 0.96 | 0.25 |
| Filtration | — | moderate | slow | fast | fast | fast |
| DIOSS | no | yes | no | yes | yes | yes |
| DINNS | no | no | no | yes | no | yes |

TABLE 1-continued

| Sample | Starting Phenates A | Starting Phenates B | Phenate/Carboxylates C | Phenate/Carboxylates D | Phenate/Carboxylates E | Phenate/Carboxylates F |
|---|---|---|---|---|---|---|
| Other | — | — | foaming | none | none | none |

DiOSS = dioctylsodium sulfosuccinate

DiNNS = calcium dinonylnaphthalene sulfonate

As shown in Table 1, all of the test samples contained a higher total base number than the calcium phenate of Sample A. Sample B which was prepared with dioctylsodium sulfosuccinate (DIOSS) in the reaction mixture possessed a lower V.I. but a higher kinematic viscosity and total base number (TBN) than Sample A. Sample B also turned hazy when subjected to aging and contained 1% sediment.

Sample C. which was based on the procedure described in EP 90301684.1 and made by adding the carboxylate while further overbasing Sample A, produced foam during the synthesis and filtered poorly. From a performance standpoint, the product responded poorly to oven aging exhibited by becoming slightly hazy (sl.hazy). By contrast, Sample D, made by adding DIOSS and DINNS, along with carboxylate, while further overbasing Sample A, was synthesized without foaming, filtered fast, and responded well to oven aging, exhibited by remaining clear. The TBN was higher than samples A, B and C, while the viscosity was low. The as-synthesized higher TBN phenates of Samples E and F, which were made by incorporating DIOSS (Sample E) or DIOSS and DINNS (Sample F) into the metal phenate reaction mixture, exhibited a higher TBN than samples A, B, C. and D. Comparing Sample E with Sample F, it is clear that the use of DINNS and DIOSS in the phenate reaction mixture (F) as opposed to DIOSS (E) helps to improve the aging stability. Sample E became very slightly hazy (v.sl.hazy) in response to oven aging while F remained very clear (v.clear) in response to oven aging.

Initial sediment measured prior to filtration and stripping consisted of undissolved inorganic salts present in the starting material. A high level of sediment indicates ineffective overbasing. The final sediment level was measured after filtration and stripping. A low level indicates that the material was easily and effectively filtered. Samples D, E and F had the lowest sediment level indicating that they filtered well, compared to sample C. Sample A was a finished product which had already been filtered so that its initial sediment cannot be compared.

It is also apparent that although the DIOSS alone is essential along with carboxylate to achieve the high alkalinity and low viscosity product of the invention (comparing the properties of Samples E and F), the calcium dinonylnaphthalenesulfonate (DINNS) helps improve the heat and age stability as indicated by solution clarity.

The total base number-viscosity plot in FIG. 1 was prepared from data obtained from the products of Examples 1-6 (Samples A, B, C, D, E and F). FIG. 1 shows the relationship of the log $KV_{100}$ vs. TBN over a wide range for all of the samples. The viscosity of each sample was measured at several TBN values by adding a diluent mineral oil to change the TBN value. The remainder of the line was extrapolated based on the data points obtained which are shown in FIG. 1. It will be noted that the dioctyl-sodium sulfosuccinate (DIOSS) and carboxylate were essential ingredients for a low viscosity product having a high TBN. (400 cst, log $KV_{100} = -2.6$, was taken as a reasonable viscosity maximum). The overbased phenates prepared in the absence of carboxylate (Samples A and B) reached the 400 cST viscosity at a lower TBN than the products made with carboxylate. On the other hand, with respect to Samples C, D, E and F, the presence of the dispersant (DIOSS and/or DINNS) was essential for producing a product with an even higher TBN (about 8-10% higher) but still possessing satisfactory viscosity properties (i.e. below 400 cSt.) Moreover, the dispersant together with carboxylate was essential for a clean and easy synthesis without the production of foam.

What is claimed is:

1. A highly alkaline, overbased phenate which comprises the reaction product of a source of alkylated phenol and a source of an alkali or alkaline earth metal-containing reagent which is overbased in the presence of a dispersant composition which includes a metal succinate and a carboxylic acid or carboxylic acid derivative.

2. The overbased phenate as described in claim 1 in which the carboxylic acid or carboxylic acid derivative has the structural formula:

$$R_5—COZ$$

wherein $R_5$ is an alkyl group containing from about 10 to 25 carbon atoms, Z is OH, OR', $NH_2$ or NHR' and R' is a 1 to 20 carbon atom alkyl group or a 2 to 20 carbon atom alcohol or alkylpolyol.

3. The overbased phenate as described in claim 1 in which the succinate is a dialkyl-metal sulfosuccinate in which the alkyl groups of the dialkyl-metal sulfosuccinate contain 4 to 16 carbon atoms.

4. The overbased phenate as described in claim 3 in which the alkyl groups of the dialkyl-metal sulfosuccinate are butyl, pentyl, hexyl, octyl, decyl, dodecyl or ethylhexyl.

5. The overbased phenate as described in claim 3 in which the metal of the dialkyl-metal sulfosuccinate is lithium, sodium, potassium, calcium, magnesium, beryllium, strontium or barium.

6. The overbased phenate as described in claim 5 in which the dialkyl-metal sulfosuccinate is dioctylsodium sulfosuccinate.

7. The overbased phenate as described in claim 1 in which the dispersant also includes a metal hydrocarbylsulfonate.

8. The overbased phenate as described in claim 7 in which the metal hydrocarbylsulfonate contains an alkylated aromatic hydrocarbyl group containing at least 8 carbon atoms.

9. The overbased phenate as described in claim 8 in which the metal hydrocarbylsulfonate is a dinonylnaphthalene-sulfonate.

10. The overbased phenate as described in claim 9 in which the metal hydrocarbylsulfonate contains beryllium, magnesium, calcium, strontium, barium or radium.

11. The overbased phenate as described in claim 1 in which the carboxylic acid derivative is methyloleate, butyloleate, glycerol monooleate, or glycerol trioleate.

12. The overbased phenate as described in claim 1 in which the carboxylic acid is oleic acid.

13. The overbased phenate as described in claim 1 which further comprises a source of sulfur whereby an overbased phenate sulfide is produced.

14. The overbased phenate as described in claim 1 in which the source of alkali or alkaline earth metal reagent is an oxide or hydroxide of sodium, potassium, lithium, calcium, magnesium or strontium.

15. The composition as described in claim 1 in which the overbased phenate comprises the reaction product of the alkylated phenol and the alkali or alkaline earth metal-containing reagent, overbased in the presence of a dispersant consisting essentially of the metal sulfosuccinate, the carboxylic acid or carboxylic acid derivative and a metal hydrocarbylsulfonate.

16. A process for preparing overbased metal phenates having improved viscometric properties, which comprises the step of overbasing a metal phenate reaction product of a source of alkylated phenol and a source of an alkali or alkaline earth metal-containing reagent in the presence of a dispersant composition which includes a metal succinate and a carboxylic acid or carboxylic acid derivative.

17. The process as described in claim 16 in which the carboxylic acid or carboxylic acid derivative has the structural formula:

$$R_5—COZ$$

wherein $R_5$ is an alkyl group containing from about 10 to 25 carbon atoms, Z is OH, OR', $NH_2$ or NHR' and R' is a 1 to 20 carbon atom alkyl group or a 2 to 20 carbon atom alcohol or alkylpolyol.

18. The process as described in claim 16 in which the metal succinate is a dialkyl-metal sulfosuccinate in which the alkyl groups are butyl, pentyl, hexyl, octyl, decyl, dodecyl or ethylhexyl and the metal is lithium, sodium or potassium.

19. The process as described in claim 16 in which the dispersant composition further includes a metal hydrocarbylsulfonate.

20. The process as described in claim 19 in which the dispersant includes calcium dinonylnaphthalenesulfonate.

21. The process as described in claim 16 in which the carboxylic acid derivative is methyloleate, butyloleate, glycerol monooleate or glycerol trioleate.

22. The process as described in claim 16 in which the carboxylic acid is oleic acid.

23. The process as described in claim 16 which includes reacting the metal phenate reaction product in the presence of a solvent system, the solvent system including a mineral oil, toluene, xylenes, monohydric alcohol or diol or a combination thereof.

24. The process as described in claim 16 in which the metal phenate reaction product includes a source of sulfur whereby a phenate sulfide is produced.

25. The process as described in claim 18 in which the dialkyl-metal sulfosuccinate is dioctyl-sodium sulfosuccinate.

26. A highly alkaline, overbased phenate which comprises the reaction product of a source of alkylated phenol and a source of alkali or alkaline earth metal-containing reagent overbased in the presence of a dispersant composition which comprises dioctyl-sodium sulfosuccinate, calcium dinonylnaphthalene sulfonate and oleic acid.

* * * * *